United States Patent [19]

Katzman et al.

[11] 4,280,297

[45] Jul. 28, 1981

[54] DOLL WITH WATER ACTIVATED SHOWER CAP

[75] Inventors: Allison W. Katzman, Chicago; Harry Disko, S. Barrington; Eugene Jaworski, Park Ridge, all of Ill.

[73] Assignee: Marvin Glass & Associates, Chicago, Ill.

[21] Appl. No.: 99,311

[22] Filed: Dec. 3, 1979

[51] Int. Cl.[3] ..... A63H 3/06

[52] U.S. Cl. ..... 46/41; 46/92

[58] Field of Search ..... 46/6, 7, 41, 44, 56, 46/91, 92; 239/17, 211

[56] References Cited

U.S. PATENT DOCUMENTS

| | | | |
|---|---|---|---|
| 612,121 | 10/1898 | Rakovsky | 46/6 |
| 1,524,802 | 2/1925 | Slater | 239/211 |
| 1,694,959 | 12/1928 | Ament | 239/211 |
| 2,544,594 | 3/1951 | Goldfarb | 46/56 X |
| 2,831,293 | 4/1958 | Götz | 46/92 X |
| 2,968,120 | 1/1961 | Reed | 46/91 |
| 3,590,515 | 7/1971 | Clark et al. | 46/6 |
| 3,736,694 | 6/1973 | Lebensfeld | 46/7 |
| 3,842,531 | 10/1974 | Sloan | 46/41 |
| 3,998.001 | 12/1976 | Meyer et al. | 46/41 X |
| 4,205,785 | 6/1980 | Stanley | 239/17 |

FOREIGN PATENT DOCUMENTS

| | | | |
|---|---|---|---|
| 64553 | 9/1892 | Fed. Rep. of Germany | 46/92 |

*Primary Examiner*—F. Barry Shay
*Attorney, Agent, or Firm*—Mason, Kolehmainen, Rathburn & Wyss

[57] ABSTRACT

A doll having a hollow body and a head is provided with a cap supported for movement on top of the head. A liquid reservoir is provided within the hollow body having a flexible wall to provide for pumping action and a conduit extends between the reservoir and an outlet adjacent the cap for directing a stream of liquid against the cap to move the cap on the doll's head when the flexible wall is depressed inwardly.

20 Claims, 5 Drawing Figures

DOLL WITH WATER ACTIVATED SHOWER CAP

BACKGROUND OF THE INVENTION

1. Field of the Invention

The present invention relates to animated dolls and more particularly, to a doll having a shower cap that is movable on the doll's head by ajet of liquid pumped from a reservoir within the hollow interior of the doll's body.

2. Description of the Prior Art wide variety of dolls and animated dolls have been provided over the years for amusement and play. Many dolls have been designed for animated action in a manner resembling common actions of a human being and these animated actions have often been developed to a highly refined level.

As far is known, however, no dolls have been provided wherein a shower cap mounted on the head of the doll is activated by a jet of liquid pumped from a reservoir within the hollow body of the doll.

OBJECTS OF THE PRESENT INVENTION

It is therefore an object of the present invention to provide a new and improved animated doll of the character described and more particularly, a doll having a shower cap mounted for movement on the doll's head in response to a jet of liquid directed against the shower cap by pumping action from a liquid reservoir in the interior of the hollow body of the doll.

Another object of the present invention is to provide an animated doll of the character described wherein the shower cap or the like is mounted for up and down movement above the head of the doll as water is pumped out and discharged in a manner simulating a shower.

Still another object of the present invention is to provide a new and improved animated doll of the character described having a movable cap which is adapted to spin around when activated by an impinging stream of liquid.

SUMMARY OF THE INVENTION

The foregoing and other objects and advantages of the present invention are accomplished in a new and improved animated doll having a hollow body and a head and a shower cap mounted for movement on top of the doll's head. A liquid reservoir serving as a pump chamber is mounted in the hollow body of the doll and includes a flexible wall which is movable to pump liquid from the reservoir upwardly through a conduit having an outlet adjacent the cap for directing a stream or jet of liquid against the cap causing movement of the cap on the doll's head and forming a shower of liquid.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENTS

Figure 1:
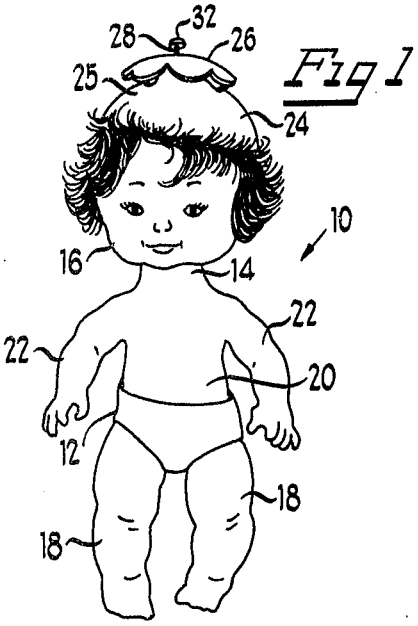
FIG. 1 is a front elevational view of an animated doll with a shower cap constructed in accordance with the features of the present invention.
Figure 3:
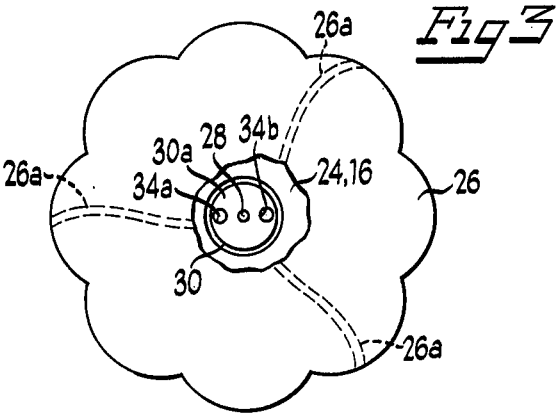
FIG. 3 is a top plan view of a shower cap on the doll's head looking downwardly in the direction of arrows 3—3 of FIG. 2, with portions broken away for clarity.

Referring now more particularly to the drawings, therein is illustrated a new and improved animated doll constructed in accordance with the features of the present invention and referred to generally by the reference numeral 10. The doll 10 includes a hollow body 12, preferably having a wall or skin formed of thin, flexible, molded plastic material and terminating in a generally cylindrical, flanged upper neck 14. The neck supports a doll's head 16 formed of similar molded plastic material and provided with the customary facial features as illustrated in FIG. 1.

The body of the doll includes a pair of depending hollow legs 18, a mid section or trunk portion and a pair of hollow arms 22 of more or less conventional construction. The hollow head 16 includes a cylindrical opening at the lower end in communication with the neck 14 and the head is mounted for adjustable rotation and is interlocked on the flange portion of the neck at the upper end thereof. An upper, generally spherical-shaped portion of the doll's head is formed to resemble a shower cap 25 with a fringe of hair 4 and a decorative element 26 on the cap with a shape generally similar to and conforming with the upper portion of the doll's head is mounted for vertical movement and rotary spinning action relative to the doll's head in accordance with the features of the present invention.

The decorative element or flower 26 is concave in shape with downturned, outwardly projecting, petal-like edges and is formed with a central aperture to accommodate an upstanding spindle portion 28 of an elongayed conduit 30 which projects upwardly through a central opening in the doll'head. The conduit or axle 30 includes a lower end portion extending downwardly into and generally coaxially of the cylindrical neck 14 of the doll'body.

Figure 4:
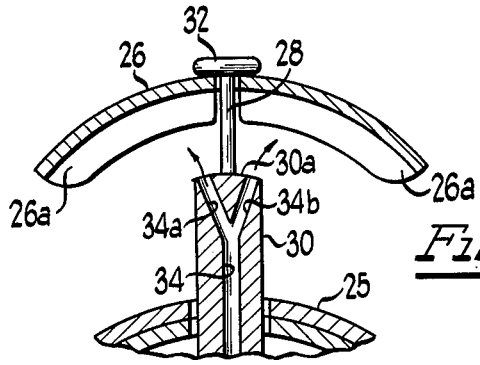
FIG. 4 is an enlarged fragmentary, upright cross-sectional view illustrating an upper portion of the doll with operative components thereof shown in another operative position.

As illustrated best in FIG. 4, at the upper end, the stem 28 is formed with a button-like stop 32 for limiting the upward travel of the flower element 26 on the stem. A lower stop surface **30*a* at the lower junction of the stem 28 and a larger diameter portion of the conduit or axle 30** provide a lower stop for limiting the downward travel of the flower on the supporting axle.

Figure 2:
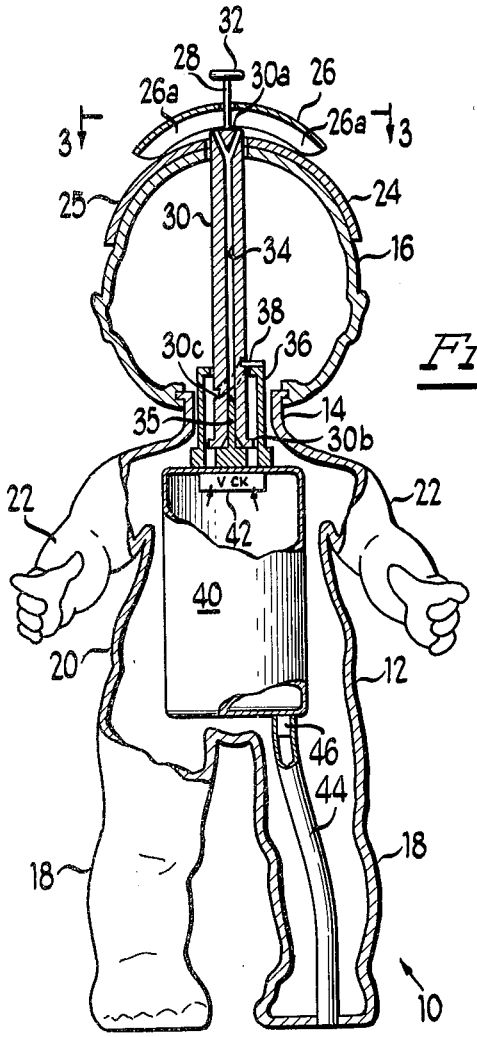
FIG. 2 is an enlarged, front, elevational view with portions broken away and shown in section to illustrate internal components of the doll of FIG. 1.

The conduit or axle 30 is formed with an elongated, centrally located fluid passage 34 extending between the upper stop surface 30a and a lower flanged end portion 30of the axle. As illustrated best in FIGS. 2 and 4, an upper end portion of the passage 34 is divided into two divergent passages 34and 34with outlets on opposite sides of the stem 28 for directing a pair of fluid streams sloped upwardly and outwardly towards the underside of the flower 26 for elevating the same to rise from a lower position adjacent the stop surface **30*i* as shown in FIG. 2 to an upper position as shown in FIG. 4 against the upper stem cap 32**.

In addition, the outwardly sloped velocity component of the fluid streams from the divergent passages 34*a* and 34*b* casuses the flower to spin around the stem 28 as these fluid streams impinge on curved radial vanes 26*a* formed on the underside of the flower element. Thus, when liquid is forced upwardly through the passage 34 of the conduit or axle 30, the liquid streams or jets issuing from the upper outlet ends of the branch passages 34*a* and 34*b* impinge against the underside of the flower causing the same to move upwardly on the stem 28 while at the same time spinning the flower around on the stem in a rotary motion. This action deflects and breaks up the pair of liquid streams discharged from the passages into a more widely dispersed, multi-stream directed downwardly and outwardly by the whirling vanes to simulate a shower on top of the doll's head of hair 24. Overall, the animated action resembles tht of a person taking a shower wherein the water flows downwardly over the lower portions of the body after initially falling on the upper portion of the figure such as the head 16 and hair 24.

In addition to the upward movement of the flower and the spinning action relative to the conduit or axle 30, the axle itself is movable vertically and rotationally on the head structure 16. The flanged lower end 30*b* of the axle conduit acts as a piston slidably mounted in a hollow cylinder 36 supported in the neck 14 at the upper end of the hollow body. The cylinder includes an upper end wall having a circular aperture 36*a* for accommodating the main body portion of the axle 30 and the lower end of the cylinder is formed with a pair of inlet passages 36*b* for directing liquid upwardly into the cylinder below the piston-like flange 30*b* of the axle 30 as indicated by the arrows "A[ in FIG. 4.

At the lower end of the cylinder there is provided an upstanding stem 35 having a pointed upper end and the stem projects upwardly into central passage 34 of the axle preventing the flow of fluid upwardly therein until the lower end 30*b* reaches a level adjacent the pointed upper end of the stem. When fluid is directed into the cylinder 36 through the inlet passages 36*b*, the axle stem 30 is moved upwardly from a lower position where the lower end flange 30*b* is resting on the lower end of the cylinder to an upwardly extended position as shown in FIG. 4 wherein the flange 30*b* is stopped against the annular upper end wall of the cylinder around the peripheral edge of the opening 36*a*. As long as sufficient pressurized fluid is present in the chamber 36, the axle conduit 30 remains in an upward position as shown in FIG. 4 and as the pressure subsides, the axle and flower 26 drop back downwardly to the rest position as shown in FIG. 2. As the axle 30 settles back onto the stem 35 there is enough clearance between the stem and passage 34 to permit liquid in the cylinder to flow into the passage until the axle reaches the lower rest position.

In order to provide a swirling motion for the jets or streams of water discharged from the divergent branch conduits 34*a* and 34*b* at the upper end of the passage 34, the axle 30 is rotated as it moves from the lower position of FIG. 2 to the upper position of FIG. 4 by the pressure of the water introduced into the lower end of the chamber 36. This rotary movement of the axle is obtained by a helical groove 30*c* formed in the outer surface of the axle which is cammingly engaged by a radial pin 38 serving as a stationary cam follower and positioned at the upper end of the sylinder 36. The upper and lower surfaces of the helical groove 30*c* provide appropriate cam surfaces for engagement with the pin 38 rotate the axle or stem 30 in opposite directions as the stem rises or lowers in the cylinder 36.

In accordance with the present invention, there is provided in the interior of the hollow flexible body 12 of the doll, a liquid reservoir 40 which serves as a pumping chamber and is formed of thin flexible molded plastic material. The reservoir is adapted to contain a volume of water and at the upper end, is in communication with the inlet passages 36*b* of the cylinder 36 through a check valve 42 which permits liquid from the reservoir to pass upwardly into the cylinder 36 but, prevents a reverse flow when inward pressure on a flexible wall of the pump reservoir is released. At the lower end, liquid is supplied to the reservoir 40 through an inlet conduit 44 and a check valve 46 which prevents a reverse flow of liquid downwardly out of the reservoir. The lower end portion of the conduit 44 extends downwardly through one of the hollow legs 18 and terminates in an inlet port on the bottom or sole of the foot of the doll's body.

In accordance with the present invention, the reservoir pump 40 is provided with flexible walls so that by squeezing the middle or trunk portion 20 of the doll's body, the inward pressure is applied to the reservoir wall and this action reduces the volume of the reservoir and pumps the fluid upwardly through the outlet check valve 42 into the cylinder 36 to raise and rotate the axle 30 and provide the liquid jets for elevating and spinning the flower 26 as the liquid streams flow out through the divergent passages 34*a* and 34*b* to create the shower-like effect around the doll's head. When the inward pressure on the flexible walls of the pump reservoir 40 is released, a new supply of water is sucked upwardly through the inlet conduit 44 in the leg of the doll and the inlet check valve 46. The pumping cycle may then be repeated by squeezing of the middle portion or trunk 20 of the doll's body to create the shower effect as described.

Figure 5:
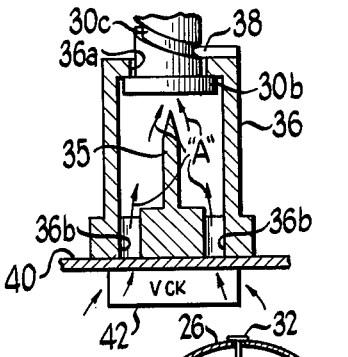
FIG. 5 is a side elevational view of a doll with portions broken away and in cross-section illustrating an alternate embodiment constructed in accordance with the features of the present invention.
Figure 5:
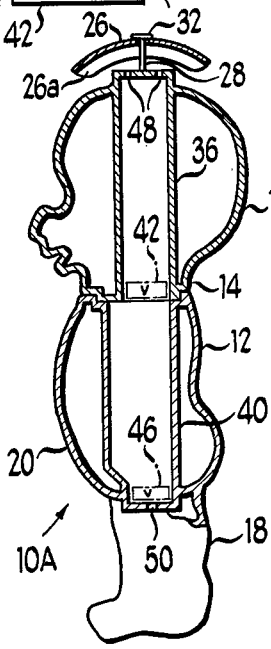

Referring now to FIG. 5, therein is illustrated an alternate embodiment of a doll constructed in accordance with the features of the present invention and referred to generally by the reference number 10A. The modified doll 10A is generally similar to the doll of FIGS. 1–4 and similar of identical reference numerals will be used to describe similar or identical components thereof. In the doll of FIG. 5, the cylinder 36 is somewhat larger and is integrally formed in the head 16 with a pair of liquid outlets in an upper end wall designated 48 which are adapted to direct streams or jets of liquid into the underside of a flower 26 to elevate and sping the same as previously described. At the lower end, the cylinder 36 is in communication with a flexible walled pump reservoir 40 through a check valve 42. The liquid reservoir is formed with a lower end wall having an inlet port 50 for providing a supply of fluid to the reservoir which flows upwardly through an inlet check valve 46. Operation of the doll 10A of FIG. 5 is generally similar to the doll 10 of the embodiments of FIGS. 1–4 and will not be described herein in detail.

Although the present invention has been described with reference to several illustrated embodiments thereof, it should be understood that numerous other modifications and embodiments can be devised by those skilled in the art that will fall within the spirit and scope of the principles of this invention.

What is claimed as new and desire to be secured by Letters Patent of the United States is:

1. A doll having a hollow body and a head,
a cap element secured on top of said head for limited movement toward and away from said head,
a liquid reservoir in said hollow body having a flexible wall,
a conduit for said liquid extending from said reservoir and passing through said head with an outlet adjacent said cap element for directing a stream of liquid through space external to said doll to impinge against said cap element to move the same away from said head when said flexible wall is compressed inwardly.

2. The doll of claim 1 wherein said cap element is mounted for rotation on axle means projecting upwardly of said outlet of said conduit.

3. The doll of claim 2 wherein said cap element is mounted for movement up and down on said axle means and is biased upwardly by a stream of liquid from said outlet.

4. The doll of claim 3 wherein said cap element includes one or more vanes extending radially of said axle means and positioned to intercept a stream of liquid from said outlet for drivingly rotating said cap when liquid impinges said vane(s).

5. The doll of claim 4 wherein said cap element is shaped to match an upper surface of said head and said vane(s) is formed on an underside of said cap.

6. The doll of claim 22 wherein said conduit is formed in said axle means and said axle means is mounted for movement up and down on said head.

7. The doll of claim 6 including a poston on said axle means slidable in a cylinder, said cylinder in communication with said reservoir for moving said axle means upwardly in response to the introduction of liquid into said cylinder from said reservoir when said flexible wall of said reservoir is compressed inwardly.

8. The doll of claim 7 wherein said conduit includes an inlet end in communication with the liquid in said cylinder.

9. The doll of claim 7 or 8 including check valve means between said cylinder and said reservoir for directing liquid into said cylinder from said reservoir when said flexible wall is compressed inwardly but preventing a reverse flow of liquid from said cylinder to said reservoir.

10. The doll of calim 7 including cam means interconnected between said piston and cylinder for rotating said axle means when said cylinder is supplied with liquid from said reservoir.

11. The doll of claim 7 wherein said piston is formed at a lower end of said axle means for movement between upper and lower ends of said cylinder.

12. The doll of claim 11 wherein said conduit includes an inlet in communication with said cylinder formed on a lower surface of said piston.

13. The doll of claim 12 wherein said cylinder includes a lower end wall having at least one port for directing fluid from said reservoir against said piston to elevate said axle means.

14. The doll of claim 13 including check valve means between said reservoir and said port for directing liquid into said cylinder against said piston and preventing a flow of liquid in a reverse direction.

15. The doll of claim 3 wherein said axle means includes a stem of reduced diameter at the upper end for supporting said cap element for rotation and movement up and down on said axle means.

16. The doll of claim 15 wherein said axle means includes a stop surface between said stem and a lower portion thereof for limiting the downward travel of said cap element thereon. pg,13

17. The doll of claim 16 wherein said outlet of said conduit is formed on said stop surface outwardly of said stem.

18. The doll of claim 17 wherein said outlet of said conduit comprises a pair of ports on said stop surface on opposite sides of said stem.

19. The doll of claim 17 or 18 wherein said conduit includes and upper end portion sloped relative to said stem for directing a discharged stream of liquid from said outlet in a direction upwardly and outwardly of said stem.

20. The doll of claim 1 including filler tube means in communication between said reservoir and an outer surface of said hollow body for filling said reservoir with liquid when said flexible wall is released from said inward compression.

* * * * *